US005191836A

United States Patent [19]

Weis

[11] Patent Number: 5,191,836

[45] Date of Patent: Mar. 9, 1993

[54] PRINTING UNIT FOR A ROTARY PRESS

[75] Inventor: Anton Weis, Lorsch, Fed. Rep. of Germany

[73] Assignee: Albert-Frankenthal Aktiengesellschaft, Wurzburg, Fed. Rep. of Germany

[21] Appl. No.: 865,944

[22] Filed: Apr. 9, 1992

[30] Foreign Application Priority Data

Apr. 19, 1991 [DE] Fed. Rep. of Germany ..... 4112925

[51] Int. Cl.[5] ..... B41F 13/24; B41F 31/36

[52] U.S. Cl. ..... 101/219; 101/247; 101/352

[58] Field of Search ..... 101/220, 221, 182, 147, 101/219, 218, 179, 180, 350, 351, 352, 207-209, 228, 181, 247

[56] References Cited

U.S. PATENT DOCUMENTS

| | | | |
|---|---|---|---|
| 2,051,573 | 8/1936 | Quick et al. | 101/221 |
| 2,425,167 | 6/1943 | Whitehead | 101/221 |
| 2,444,547 | 7/1948 | Whitehead | 101/221 |
| 5,081,928 | 1/1992 | Harrison | 101/351 |

FOREIGN PATENT DOCUMENTS

| | | | |
|---|---|---|---|
| 0026628 | 4/1981 | European Pat. Off. | 101/247 |
| 2033836 | 7/1970 | Fed. Rep. of Germany . | |
| 2844418 | 10/1978 | Fed. Rep. of Germany . | |
| 7922181 | 7/1979 | Fed. Rep. of Germany . | |
| 3313219 | 10/1984 | Fed. Rep. of Germany | 101/351 |
| 270363 | 12/1925 | United Kingdom . | |

*Primary Examiner*—J. Reed Fisher

*Attorney, Agent, or Firm*—Jones, Tullar & Cooper

[57] ABSTRACT

A printing unit for a rotary printing press can accomplish a flying plate change by utilizing a pair of forme cylinders in conjunction with an impression cylinder and an ink forme roller which are both pivotably supported. Both the impression cylinder and the ink roller can be moved into engagement with one of the forme cylinders while the printing plate on the other forme cylinder is being changed.

5 Claims, 4 Drawing Sheets

PRINTING UNIT FOR A ROTARY PRESS

FIELD OF THE INVENTION

The present invention is directed generally to a printing unit for a rotary printing press. More particularly, the present invention is directed to a printing unit usable for a flying printing plate change. Most specifically, the present invention is directed to a printing unit having two forme cylinders and a shiftable impression cylinder and ink roller. The impression cylinder and the ink roller are each supported for pivotable movement between positions where they contact one or the other of the two forme cylinders. Each of the forme cylinders has a separate, engageable electric drive motor so that it can be uncoupled from the main press drive and stopped to effect a printing plate change. While one forme cylinder is undergoing a printing plate change, the paper web is being printed by the other forme cylinder.

DESCRIPTION OF THE PRIOR ART

Printing units which are able to accomplish a so-called flying plate change are generally known in the art. In devices of this type, the object is to accomplish the changing of a printing plate or printing forme on a plate or forme cylinder without the necessity of stopping printing. One such prior art device that is usable to accomplish a flying printing plate change is shown in German patent No. 20 33 836. In this device, the impression cylinder is arranged so that it can be swivelled and can be brought into contact with two plate cylinders. The paper web that is being printed wraps around the impression cylinder. As the impression cylinder swivels between the two plate cylinders the paper web tension is apt to be varied.

In the German patent specification No. 33 13 219 there is shown a printing unit that is usable to execute a flying plate change. This prior art device uses a single ink forme roller and either of two plate cylinders can be thrown onto or moved into contact with the ink forme roller. The device for effecting the throwing-on of the plate cylinders is executed in the form of a slide on which both forme cylinders are both rotatably and drivably supported. Through movement of the slide, only one of the forme cylinders will be thrown onto the ink forme roller. This results in the second forme cylinder being thrown off the ink forme roller.

It will be apparent that there is a need for a printing unit for a rotary printing press which overcomes the limitations of the prior art devices while still facilitating the accomplishment of a flying plate change in an expeditious manner. The printing unit for a rotary press in accordance with the present invention provides such a device and is a significant improvement over the prior art devices.

SUMMARY OF THE INVENTION

It is an object of the present invention to provide a printing unit for a rotary press.

Another object of the invention is to provide a printing unit for the execution of a flying printing plate change in a printing unit of a rotary printing press.

A further object of the present invention is to provide a printing unit having an impression cylinder which is supported for pivotable movement between two forme cylinders.

Still another object of the present invention is to provide a printing unit having an ink roller and fountain assembly that is pivotable between two forme cylinders.

Yet a further object of the present invention is to provide a printing unit having auxiliary drive units for each of the two forme cylinders.

As will be discussed in greater detail in the description of the preferred embodiment which is set forth subsequently, the printing unit for a rotary press in accordance with the present invention is usable to accomplish a flying plate change by using two forme cylinders that are each selectively engageable by a pivotably or swivellably supported impression cylinder and a similarly supported ink fountain assembly. Both of the forme cylinders are driven by the printing press drive through suitable disengageable coupling assemblies. When it is desired to effect a flying plate change on one of the forme cylinders, the impression cylinder and the ink roller are moved out of contact with that forme cylinder and into contact with the other forme cylinder. The disengaged forme cylinder is disconnected from the press drive and is coupled to its own electric motor which is used to stop it. The plate change is then made. The forme cylinder can then be brought up to the proper rotational speed by its own electric motor and can then be reengaged with the main press drive. The impression cylinder and ink roller can then be brought into contact with the reengaged forme cylinder.

Various advantages result from the structure of the present invention. The impression cylinder throwing on or throwing off functions can be carried out over the impression cylinder with nearly no register variations taking place. It is also possible to use a variable sized forme cylinder. The present invention also allows the use of a simple eccentric for adjusting the impression pressure of the impression cylinder against the forme cylinder. In addition, it is possible to adjust the impression pressure of the ink roller against the forme cylinder by using simple means.

The printing unit for a rotary printing press in accordance with the present invention facilitates a flying plate change in a manner which overcomes the limitations of the prior art devices. It is a substantial improvement in the art.

BRIEF DESCRIPTION OF THE DRAWINGS

While the novel features of the printing unit for a rotary press in accordance with the present invention are set forth with particularity in the appended claims, a full and complete understanding of the invention may be had by referring to the description of the preferred embodiment, as set forth subsequently, and as illustrated in the accompanying drawings, in which:

DESCRIPTION OF THE PREFERRED EMBODIMENT

Figure 1:
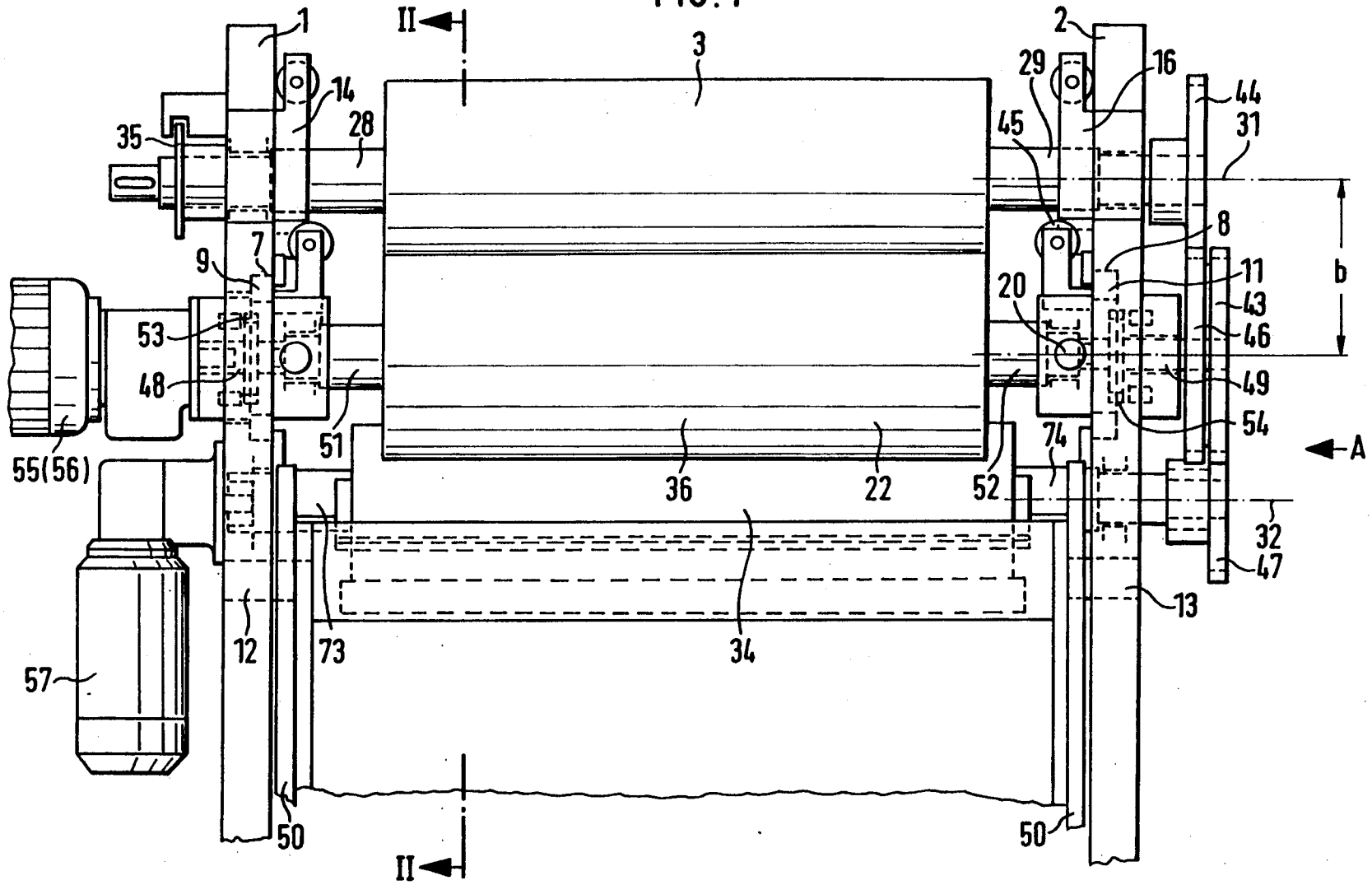
FIG. 1 is a front elevation view of the printing press in accordance with the present invention.
Figure 2:
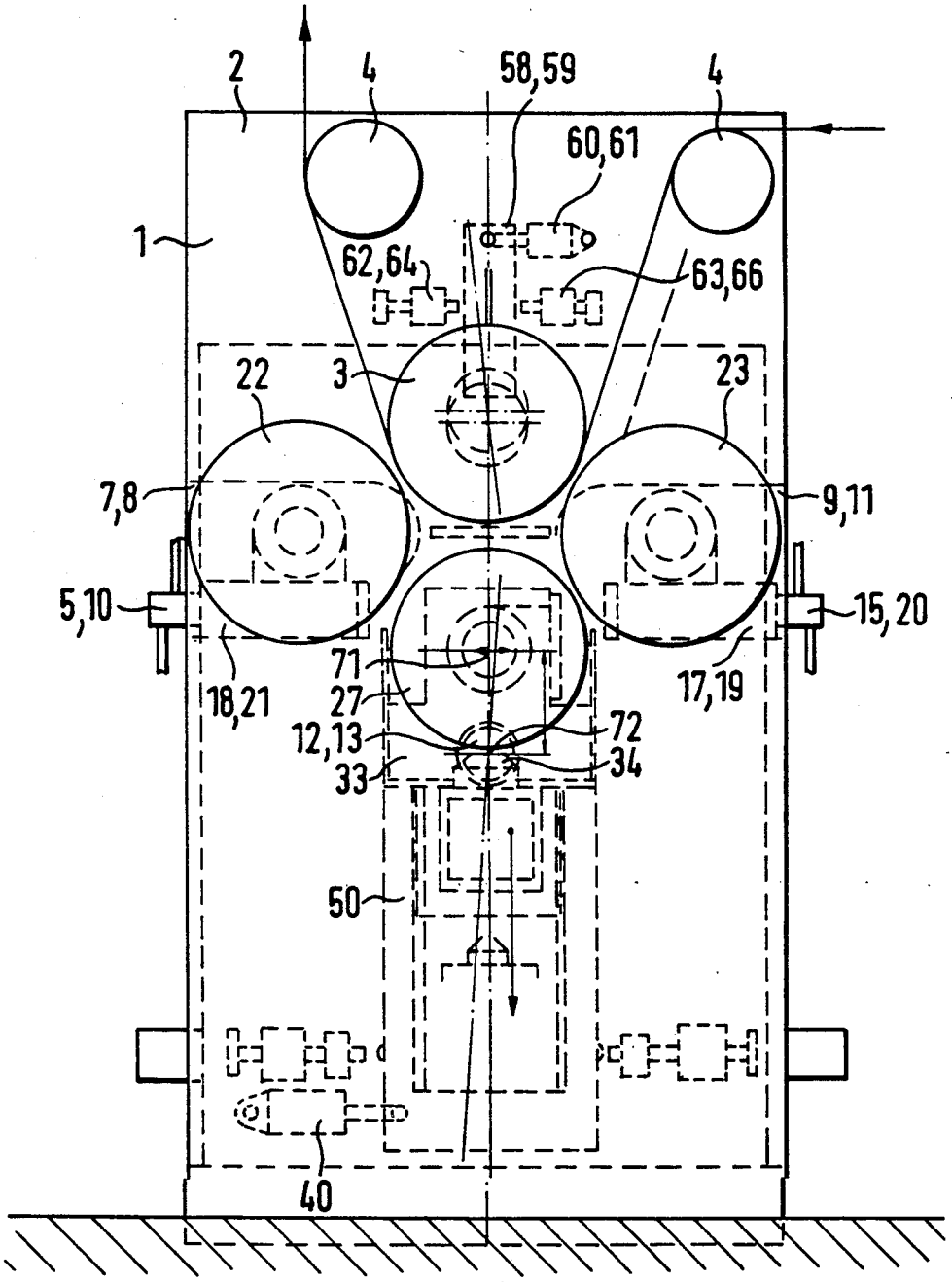
FIG. 2 is a cross-sectional view taken along line II—II of FIG. 1.
Figure 5:
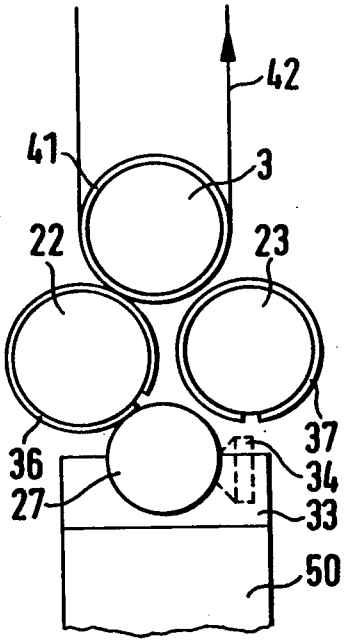
FIG. 5 is a schematic depiction of the printing unit of the present invention during use in flexographic printing.

Referring initially to FIGS. 1 and 2, there may be seen a preferred embodiment of a printing unit for a rotary press in accordance with the present invention. A pair of generally conventional spaced side frames and 2 of the printing unit support an impression cylinder 3 and a pair of spaced idler rollers 4, as may be seen in FIG. 2. A paper web 42, as may be seen in FIGS. 5–7, passes around the impression cylinder 3 and the idler rollers 4. The paper web 42 is printed by contacting one of two forme cylinders 22 and 23 which are also supported between the side frames 1 and 2. An ink roller 27 and its associated ink trough 33 and doctor blade 34 are used to ink the printing plates or formes carried on the forme cylinders 22 and 23. As will be discussed in detail shortly, the impression cylinder 3 and the ink roller 27 are supported between the side frames 1 and 2 such that they can be pivoted or swivelled into engagement with either one of the forme cylinders 22 or 23 while a flying plate change is being accomplished on the other forme cylinder.

Figure 4:
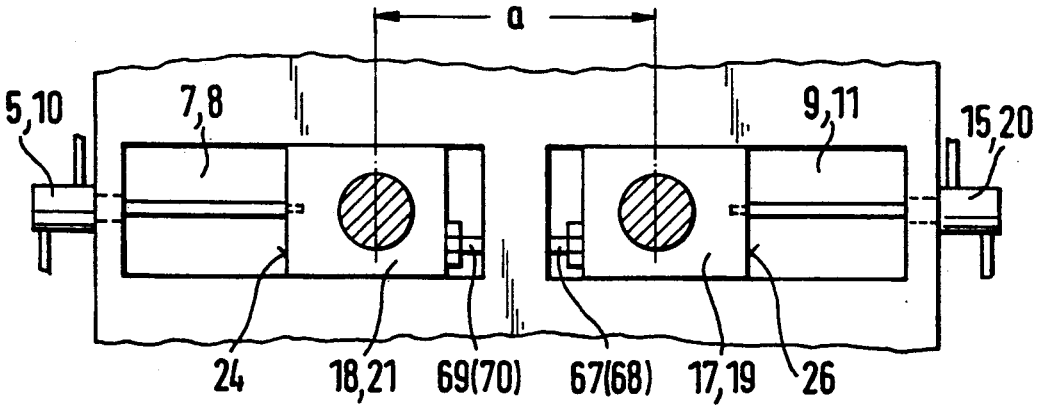
FIG. 4 is a side elevation view of a portion of the printing unit and showing the crossheads for the forme cylinders.

Turning now to FIG. 4 taken in conjunction with FIGS. 1 and 2 there may be seen a pair of horizontal guide recesses 7 and 9 or 8 and 11 which are formed in side frames 1 and 2, respectively. Each of these generally rectangular guide recesses 7, 8, 9, or carries a cooperatively shaped slidable crosshead 18, 21, 17, or 19. Each of these crossheads may ride in a suitable dove-tail guide groove in the guide recess and may be lockable in a selected position therein.

In the crossheads 18 and 21, facing each other in the side frames 1 and 2, there is supported the first forme cylinder 22. In the crossheads 17 and 19 there is supported the second forme cylinder 23 with both cylinders 22 and 23 being carried by suitable bearings. In an initial position, each of the crossheads 17, 18, 19, and 21 is pressed against a suitable stop (not shown) by means of a hydraulic cylinder or the like. In this position, an axle base "a" between the first and second forme cylinders 22 and 23 is sufficiently large that, depending on the position, the first forme cylinder 22 or the second forme cylinder 23 can be brought into contact with the impression cylinder 3, as well as with the ink forme roller 27. The ink forme roller 27 is arranged in a swivellable swinging arm 50, together with its associated ink trough 33 and doctor blade 34. The swinging arm 50 is arranged between the side frames 1 and 2 and is supported in them. The ink forme roller 27 can be driven in a generally conventional manner by the main drive of the press or by its own driving motor 57, which is shown in FIG. 1.

Again referring to FIG. 4, each of the crossheads 18, 21, 17, and 19 is shiftable in its respective guide recess or slot 7, 8, 9 or 11 by use of a suitable double acting hydraulic cylinder 5, 10, 15 or 20. The free end of the piston rod of each such cylinder is attached to one of the sliding crossheads while the thrust bearing of each of the cylinders is secured to the side frame 1 or 2. A suitable hydraulic control unit arrangement can be used to ensure that the crosshead pairs 18 and 21 for forme cylinder 22 and the crosshead pairs 17 and 19 for forme cylinder 23 will each move the same amount in each of the two side frames 1 and 2. A suitable hydraulic control unit for this purpose is set forth in German utility model No. 79 22 181.

The ink forme roller 27 is drivably supported by suitable cylinder journals 73 and 74 below the impression cylinder 3 and below both axes of rotation of the forme cylinders 22 and 23 by a swinging arm assembly 50. The swinging arm assembly 50, and thus the ink forme roller 27, is swivellable around a swivelling axis 72, which is parallel to an axis of rotation 32 of the ink forme roller 27, and which passes through the centers of two swinging arm support journals 12 and 13 in the side frames 1 and 2. Thus the swinging arm assembly 50 is supported below the axis of rotation 32 of ink forme roller 27 and between the side frames 1 and 2, all as may be seen most clearly in FIGS. 1 and 2.

To produce the swivelling motion of the swinging arm assembly 50, there is provided a double-acting hydraulic cylinder 40. As seen in FIG. 2, the cylinder 40 is attached to the inner side of the side frame 1 or 2. A distance of the axis of rotation 32 of the ink forme roller 27 from the center of the journals 12, 13 is chosen in this connection so, that the surface of the ink forme roller 27 can be brought into contact alternately with the surface of the forme cylinders 22 or 23 by suitable movement of the swinging arm assembly 50 through actuation of the hydraulic cylinder 40. Suitable adjustable stops are provided on the inner surfaces of the side frames 1 and 2 to limit the extent of movement of the swinging arm assembly 50.

The ink forme roller 27 may be executed as a hard, screened roller or anilox-roller. In this case, it immerses into the ink trough 33, which is filled with a flexo printing ink or with another low-viscosity ink, such as with low-viscosity letterpress ink. Excess printing ink is doctored away from the ink forme roller in a known way by means of the doctor blade 34. In case the ink forme roller 27 has a hard surface, as is the case when a screened roller is employed, there must be flexible printing formes 36 and 37 clamped on the forme cylinders 22 and 23. These are depicted schematically in FIG. 5.

Figure 7:
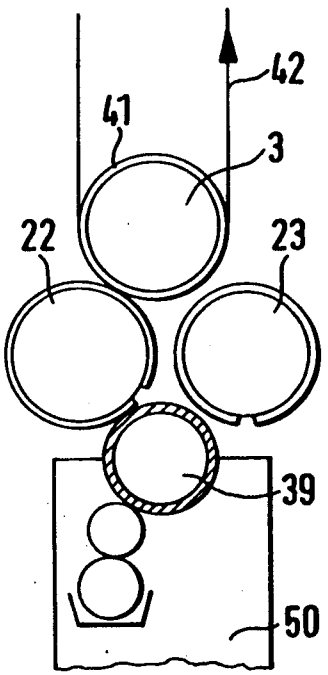
FIG. 7 is a schematic depiction of the printing unit during use in letterpress printing.
Figure 6:
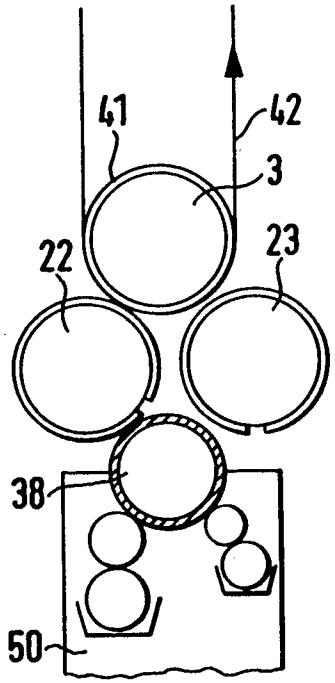
FIG. 6 is a schematic depiction of the printing unit during use in offset printing.

The ink forme roller 27 can alternatively be executed as the last roller 38 of an offset inking unit, as seen in FIG. 6 or as the last roller 39 of a letterpress inking unit, as seen in FIG. 7. In this case, the rollers 38, 39 must have an elastic rubber dressing. In case there are used rollers 38 and 39 with elastic dressings, the forme cylinders 22, 23 have to be covered with so-called hard printing plates, which means with offset, or letterpress printing plates. Plate clamping devices for the forme cylinders 22, 23 are known in general and thus are not described. In accordance with the employment of hard or flexible printing plates, a coating 41 of the impression cylinder 3 has to be flexible or hard. Such impression cylinders 3 are known in general. The peripheral speeds of the impression cylinder 3, the forme cylinder 22 and 23, and of the ink forme roller 27 are to be the same. The diameter of the ink forme roller 27 is preferably equal to the diameter of impression cylinder 3. The diameters of the forme cylinders 22 and 23 can be variable, but they can also have the same diameter as the ink forme roller 27.

The inking units such as an anilox-inking unit, a gravure-inking unit, an offset-inking unit or a letterpress-inking unit are mounted in the swinging arm assembly 50 of the invention. A drive for the rollers of the same can be effected over a coupling with axle offset, a so-called Schmitt-trigqer, by the main drive of the machine. The paper web 42 is printed on one side in a printing nip between the impression cylinder 3 and the forme cylinder 22 or the forme cylinder 23.

An axle base distance "b", as seen in FIG. 1, between the impression cylinder 3 and the axis of rotation of the forme cylinders 22 and 23 is chosen so that in an impression throw-on position of the impression cylinder 3, the impression cylinder 3 can alternately be brought into contact with either of the forme cylinders 22 or 23. For this purpose, cylinder journals 28 and 29 of impression cylinder 3 are supported in eccentric bushings 14 and 16, which themselves are supported in boreholes in the side frames 1 and 2. Each of the eccentric bushings 14 and 16 has an associated lever arm 58 or 59 which is connected with a suitable double-acting hydraulic cylinder 60 or 61 as seen most clearly in FIG. 2. These hydraulic cylinders 60 and 61 are simultaneously actuated in such a way that the impression cylinder 3 is pressed against the right forme cylinder 23 or against the left forme cylinder 22 and in this way presses the paper web 42 against them. To the left and to the right adjacent the lever arms 58 and 59, there are attached adjustable stops which are serving as limit stops for the pivot angle of the impression cylinder 3.

Figure 3:
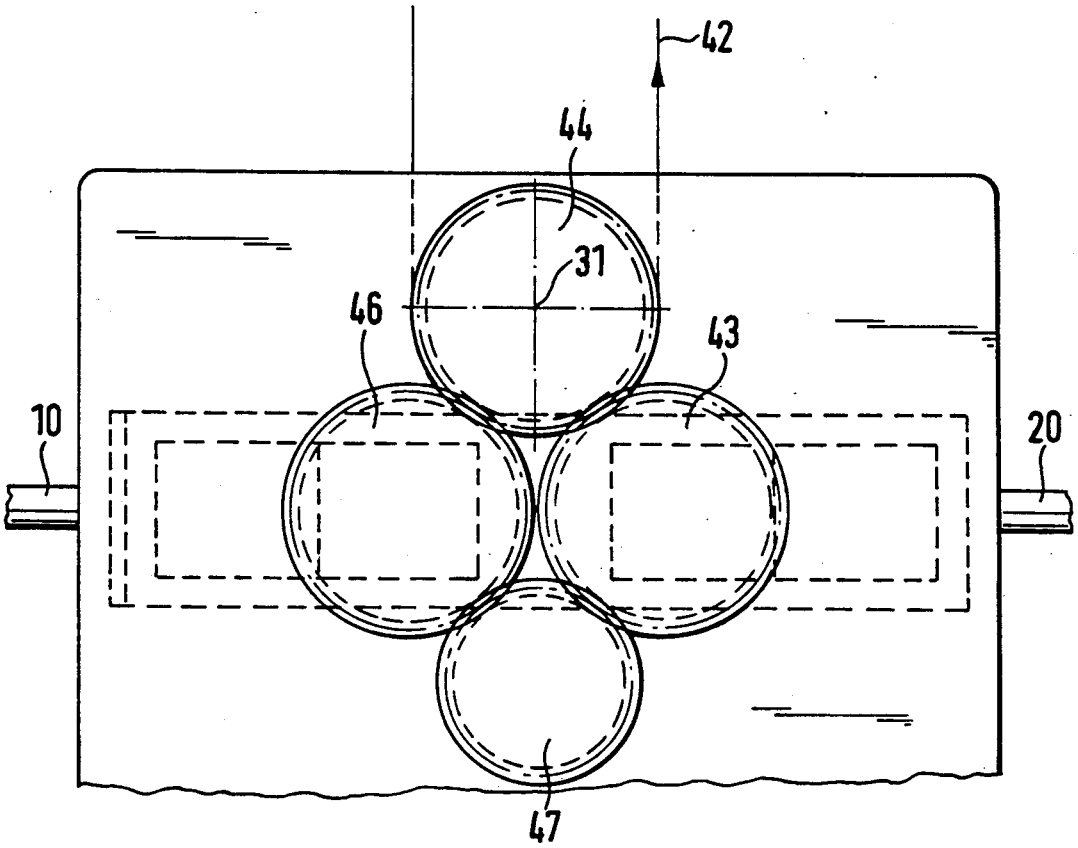
FIG. 3 is a side elevation view of the printing unit of FIG. 1 and taken in the direction indicated by A in FIG. 1.

Turning now to FIG. 3 and referring also to FIG. 1 the drive assemblies for the forme cylinders 22 and 23, the impression cylinder 3 and the ink forme roller 27 may be seen. As depicted schematically in FIG. 3, there are provided four spur wheels or gears 44, 46, 43, and 47 which are keyed on the driving shafts of the cylinders 3, 22, 23 and 27 respectively. The spur wheel 43 is executed as a double gear wheel. There is effected a power drive to the spur wheel 44 from the main drive of the press. The outer gear wheel of the spur wheel 43 meshes with the spur wheel 47, which drives the ink forme roller 27. The inner gear wheel of the spur wheel 43 meshes with the spur wheel 44 for the impression cylinder 3. The spur wheel 44 also drives the spur wheel 46 of the forme cylinder 22. The gear drive 47 for the ink forme roller 27 can be provided with an interpositioned overrunning clutch, This will allow the ink forme roller 27 to be disconnected from the gear 47 and rotated by an electric motor 57 that is attached to the side frame. Thus the ink roller 27 can be moved even when the main press is off.

In order to accomplish a so-called flying plate change, it is necessary that the two forme cylinders 22 and 23 be capable of being disconnected from their gear wheels 43 and 46 since these gear wheels are always in gear mesh engagement with the main drive of the printing press. As may be seen most clearly in FIG. 1, there is connected between both bearing journals 48 and 49 and between both cylinder journals 51 and 52 of the forme cylinders 22 and 23 an electrically switchable and separable coupling 53 or 54, such as a pole adding coupling. On each of the left bearing journals 48 of both forme cylinders 22 and 23, there is a controllable electric motor 55 or 56, such as a direct current motor, with a flanged encoder disc for measuring the actual number of revolutions. The electric motor 55 is secured to the crosshead 17 and the electric motor 56 is secured to the crosshead 18. On the cylinder journal 28 of the impression cylinder 3, there is also carried an encoder disc 35, which measures the nominal number of revolutions. Actuation of the couplings 53 or 54 will result in the associated forme cylinder 22 or 23 being either coupled to or uncoupled from its associated electric motor 55 or 56 or coupled to or uncoupled from its associated gear wheel which is driven by the printing press main drive. Thus the forme cylinders 22 and 23 can each be selectively driven through the main press drive or can be uncoupled from the press drive and driven by their associated electric motors.

The operation of the printing unit for a rotary press in accordance with the present invention during a so-called flying plate change will now be discussed. While the plate exchange procedure for "impression-on" and "impression-throw off" for only forme cylinder 23 will be discussed, it will be understood that the procedure is the same for both forme cylinders 22 and 23. For placing a new printing forme 37 on the forme cylinder 23, the impression cylinder 3 and the single ink forme roller 27, which both selectively cooperate with one of the two forme cylinders 22 or 23, must be moved away from the forme cylinder 23. This is effected by a simultaneous shifting of the crossheads 17 and 19, so that forme cylinder 23, is freed from the ink forme roller 27 and the impression cylinder 3. Then, the forme cylinder 23 is shut down. The shut down is effected when the coupling 54 on the side of the spur wheel is put out of operation and the coupling 53 on the side of the direct current motor is put into operation, so that the forme cylinder 23 is then coupled with the direct current motor 56, running at a speed equal to the speed of the forme cylinder 23. Then the forme cylinder 23 is braked until standstill and is then switched off. The shifting of the crossheads 18 and 21 or 17 and 19 is effected by simultaneously actuating the double-acting hydraulic cylinders 5 and 10 or 15 and 20 the thrust bearings of which are attached to the inner side frames 1 and 2 and the forked heads of which are attached to the outer sides 24 or 26 of the crossheads 18 and 21 or 17 and 19. In the "impression throw-on position" and in the "waiting position", the crossheads 17 and 19 or 18 and 21 are always pressed against adjustable stops 67 and 68 or 69 and 70.

During printing plate exchange, the forme cylinder 23, which is being covered by a new printing forme 37, is held by means of both hydraulic cylinders 15 and 20, acting between the crossheads 17 and 19, in its position, this means, in the position at the stops 67 and 68. In this position, there is a gap of 1-2 mm between forme cylinder 23 and ink forme roller 27 and between forme cylinder 23 and the impression cylinder 3. The electric drive 56 is turned off and the coupling 54 with the spur wheel 43 is disconnected. Then, the electric drive 56 is actuated and its number of revolution is increased until the forme cylinder 23 and impression cylinder 3 have the same peripheral speed. In that moment, the coupling 54 is connected between forme cylinder 23 and the spur wheel 43 and the coupling connection 53 between forme cylinder 23 and electric drive 56 is released, which means, the forme cylinder 23 is then driven by the main drive of the machine. Then, the hydraulic cylinders 40, 60, and 61 are actuated so, that the impression cylinder 3 and the ink forme roller 27 are moved and are pressed against the forme cylinder 23 in the "impression throw-on position". In this position, the ink forme roller 27 inks a printing forme 37 on the forme cylinder 23. The paper web 42 is then printed between forme cylinder 23 and impression cylinder 3. Movement of the impression cylinder 3 and ink forme roller 27 into the "impression throw-on position" contacting the forme cylinder 23, results in the other forme cylinder 22 being brought into an "impression throw-off position", which means brought out of contact with the impression cylinder 3 and the ink forme roller 27. This cylinder may then be uncoupled from the spur wheel 46, then coupled with the electric motor 55, running with a corresponding speed, and then braked by means of the above-described electric braking process until standstill.

Various devices are known that are usable to synchronize the speeds of rotation of the electric motors with the cylinders so that the forme cylinders 22 and 23 will be in synchronous rotational speed with their associated gear drives when their electric motors are disengaged. These speed synchronization devices are used, for example in the shiftless drive of printing units or in the synchronization of reelstands with printing units. These devices are also used to synchronize the speed of a new paper roll with the speed of an unwinding web. Since these devices are known, it is not necessary to describe them in detail in this application.

As was discussed above, and as is shown schematically, the printing unit in accordance with the present invention is not limited to use with any particular printing process, such as gravure printing. It can be used with flexographic, offset and letterpress printing.

While a preferred embodiment of a printing unit for a rotary press in accordance with the present invention is set forth fully and completely hereinabove, it will be understood that a number of changes in, for example the type of clutch assemblies used, the type of ink trough and doctor blade assembly, the hydraulic actuators used and the like may be made without departing from the true spirit and scope of the invention which is accordingly to be limited only by the following claims:

What is claimed is:

1. A printing unit in a rotary printing press capable of executing a flying plate change, said printing unit comprising:

first and second forme cylinders;

an impression cylinder engageable with a selected one of said first and second forme cylinders;

means to move said impression cylinder between first and second printing positions in contact with said first and second forme cylinders;

an ink forme roller engageable with a selected one of said first and second forme cylinders and having an axis of rotation, said ink forme roller being movable between said first and second printing positions about a swivel axis, said axis of rotation of said ink forme roller being intermediate said first and second forme cylinders and said swivel axis and parallel thereto;

an inking unit associated with said ink forme roller and movable about said swivel axis;

a swinging arm assembly supporting said ink forme roller and said inking unit, said swinging arm assembly being movable about said swivel axis; and means to move said ink forme roller between said first and second printing positions in contact with said first and second forme cylinders by moving said swinging arm assembly about said swivel axis.

2. The printing unit of claim 1 wherein said impression cylinder is supported between spaced eccentric bushings which are shiftable by spaced lever arms to effect said movement of said impression cylinder between said first and second printing positions.

3. The printing unit of claim 1 wherein said first and second forme cylinders are each shiftably supported in first and second spaced side frames of said rotary printing press.

4. The printing unit of claim 3 wherein each of said first and second side frames has first and second spaced guide recesses and further wherein each of said first and second guide recesses in each of said first and second side frames slidably supports a forme cylinder end supporting crosshead.

5. The printing unit of claim 4 wherein each of said crossheads is slideable by a hydraulic cylinder.

* * * * *